US006691429B1

(12) United States Patent
Carlucci et al.

(10) Patent No.: US 6,691,429 B1
(45) Date of Patent: Feb. 17, 2004

(54) HAIR DRYER WITH STAND

(75) Inventors: Vito James Carlucci, Stratford, CT (US); Jong Sik Lim, Rye, NY (US); Henri Christophe Frederic Joseph Smal, Vise (BE)

(73) Assignee: Conair Corporation, Stamford, CT (US)

( * ) Notice: Subject to any disclaimer, the term of this patent is extended or adjusted under 35 U.S.C. 154(b) by 0 days.

(21) Appl. No.: 10/294,257

(22) Filed: Nov. 14, 2002

(51) Int. Cl.[7] ..... F36B 19/00
(52) U.S. Cl. ..... 34/90; 34/96; 34/239
(58) Field of Search ..... 34/90, 96, 239; 248/121, 125.8, 125.9, 160, 161

(56) References Cited

U.S. PATENT DOCUMENTS

| | | | | |
|---|---|---|---|---|
| D177,361 S | | 4/1956 | Bentzman | D86/10 |
| D183,663 S | | 10/1958 | Russel | D86/10 |
| D253,074 S | | 10/1979 | Wistrand | D28/16 |
| 4,712,313 A | * | 12/1987 | Gettleman | 34/97 |
| 5,737,847 A | * | 4/1998 | Britton | 34/97 |
| 5,842,670 A | | 12/1998 | Nigoghosian | 248/160 |
| 5,937,537 A | | 8/1999 | Miller | 34/97 |
| 5,940,980 A | | 8/1999 | Lee et al. | 34/97 |
| 5,970,622 A | * | 10/1999 | Bahman | 34/97 |
| 6,108,934 A | * | 8/2000 | Todorovic | 34/283 |
| 6,199,805 B1 | | 3/2001 | Pena | 248/125.8 |

FOREIGN PATENT DOCUMENTS

| | | |
|---|---|---|
| JP | 403168103 | 7/1991 |
| JP | 407000221 | 1/1995 |
| JP | 408112134 | 5/1996 |

* cited by examiner

*Primary Examiner*—Jiping Lu
(74) *Attorney, Agent, or Firm*—Ohlandt, Greeley, Ruggiero & Perle, LLP

(57) ABSTRACT

There is provided a stand for use with a hand held hair dryer. The stand selectively cooperates with a handle of the hand held hair dryer to form a tripod and enable a user to operate the hand held hair dryer in a hands-free manner. The stand can telescopically cooperate with the hand held hair dryer in such a manner to allow the hand held hair dryer to be selectively, tilted, angled and/or positioned when rested on or supported against a surface. The stand provides a user with greater flexibility in use and enhances the effectiveness/efficiency of the hand held hair dryer.

20 Claims, 3 Drawing Sheets

HAIR DRYER WITH STAND

BACKGROUND OF THE INVENTION

1. Field of the Invention

The present invention relates to a support or stand for use with a hand held hair dryer. More particularly, the present invention relates to a compact stand that is telescopically connected to the hand held hair dryer.

2. Description of the Prior Art

The present prior art provides a variety of techniques for operating conventional hand held hair dryer in a hands-free manner through the use of various stands. Examples of such stands are provided in U.S. Pat. Nos. 6,199,805, 5,940,980, 5,937,537, and 5,842,670. There are many shortcomings associated with these known hand held hair dryer stands. For example, some are bulky, inconvenient and relatively awkward to handle. Others require connection with a wall or door, and/or are relatively immovable. Still other known hand held hair dryer stands have a limited range of motion in which the hand held hair dryer may be used. None provide for a stand that can be selectively telescopically received, retained and stored by the hand held hair dryer. Thus, there is a need for a stand for use with a hand held hair dryer that is compact, portable, easily/efficiently utilized and stored, as well as provide substantial variation in use.

SUMMARY OF THE INVENTION

It is an object of the present invention to provide a stand for use with a hand held hair dryer having advantages over and above that which is taught by the prior art.

It is another object of the present invention to provide such a stand that is compact, lightweight and portable.

It is still another object of the present invention to provide such a stand that it easily and conveniently used and stored.

It is a further object of the present invention to provide such a stand that can selectively telescopically cooperate with the hand held hair dryer.

It is still a further object of the present invention to provide such a stand that enables a user to use the hand held hair dryer in a hands-free manner.

It is yet still a further object of the present invention to provide such a stand that gives the user substantial flexibility in use.

These and other objects and advantages of the present invention are achieved by a stand having at least two legs individually, telescopically connected to a hand held hair dryer, and alternatively joined by a connecting member.

BRIEF DESCRIPTION OF THE DRAWINGS

The present invention is more fully understood by reference to the following detailed description of an illustrative embodiment in combination with the drawings identified below.

DETAILED DESCRIPTION OF THE INVENTION

Figure 1:
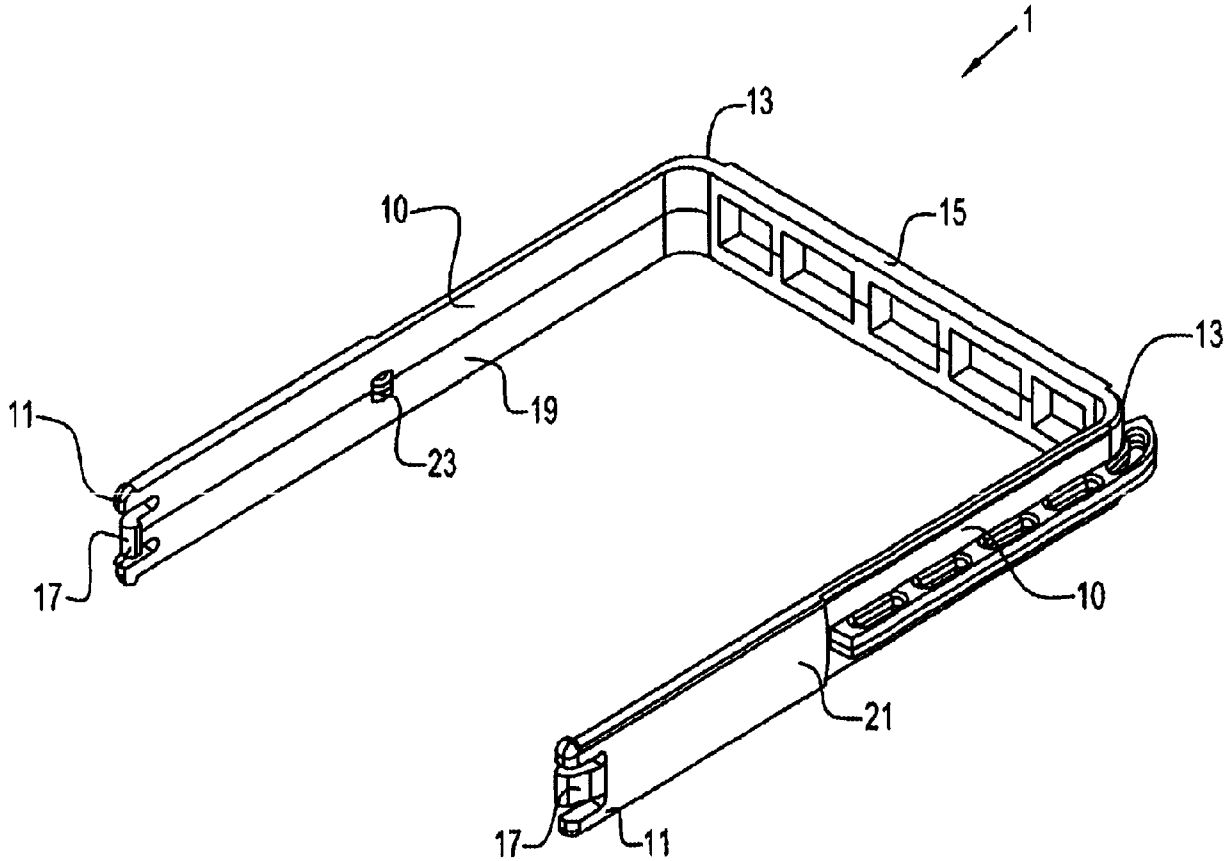
FIG. 1 is a perspective view of a stand in accordance with an illustrative embodiment of the present invention.

Referring to the drawings and, in particular, FIG. 1, there is shown an illustrative embodiment of a stand of the present invention generally represented by reference numeral 1. Stand 1 is for use with a hand held hair dryer 5, such as that shown in FIG. 4. Stand 1 has at least two legs 10 that telescopically cooperate with the hand held hair dryer 5. Further, stand 1 can also have a connecting member 15 for connecting the at least two legs 10.

Figure 3:
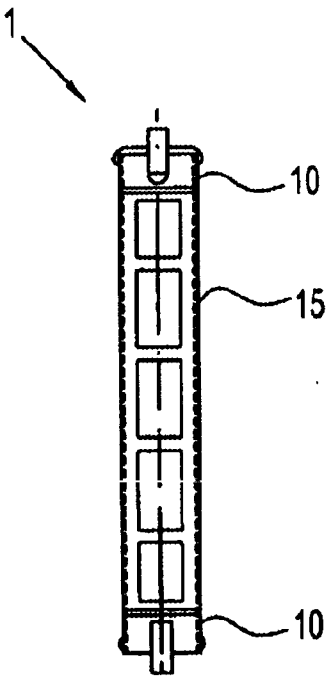
FIG. 3 is an end view of the stand of FIG. 1.
Figure 2:
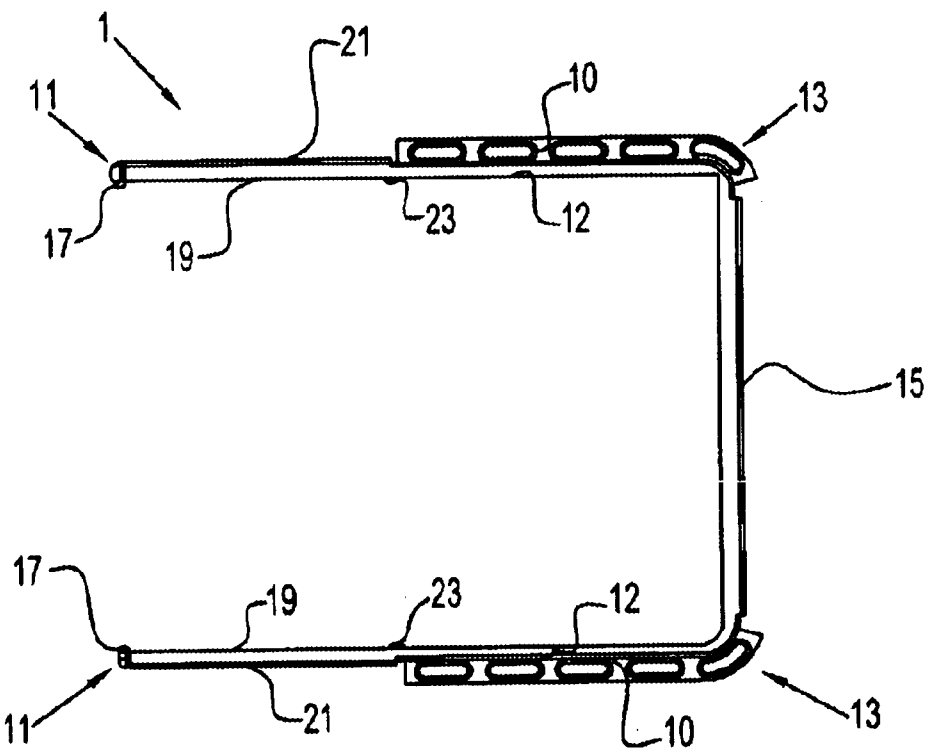
FIG. 2 is a plan view of the stand of FIG. 1.

Referring to FIGS. 1 through 3, legs 10 can be mad of a material that is lightweight yet sufficiently strong to support the hand held hair dryer 5. Preferably, this material is a plastic or ceramic. Also preferably, legs 10 can be finished to aesthetically compliment hand held hair dryer 5. The legs 10 are preferably configured and positioned so as not to interfere with the operation of hand held hair dryer 5 when in use.

Preferably, each leg 10 has a first end 11, an elongated shaft 12, and a second end 13 opposite first end 11. Preferably, each first end 11 has one or more connectors 17 for cooperating with one or more corresponding fasteners 7 on hand held hair dryer 5. Preferably, the legs 10 are independently, telescopically connected to hand held hair dryer 5. This independent telescopic relationship between the legs 10 and hand held hair dryer 5 allows hand held hair dryer 5 to be selectively, tilted, angled and/or positioned when rested or supported against a surface, thereby providing greater variation in the orientation of the hand held hair dryer during use thereof.

Preferably, elongated shaft 12 has an first surface 19 providing a sliding contact with hand held hair dryer 5 and a second surface 21 providing a gripping contact that facilitates user handling. Preferably, first surface can have one or more bosses 23. Bosses 23 can, for example, provide a frictional contact with hand held hair dryer 5, and can engagably cooperate with various indentations or the like commonly found in hand held hair dryers to provide added stability, and can engagably cooperate with one or more notches to selectively position the legs 10 relative to hand held hair dryer 5. It is noted that first surface 19 can also have structures such as, for example, channels, apertures, and/or any other type of indentations or projections for facilitating the functional relationship between legs 10 and hand held hair dryer 5.

Figure 4:
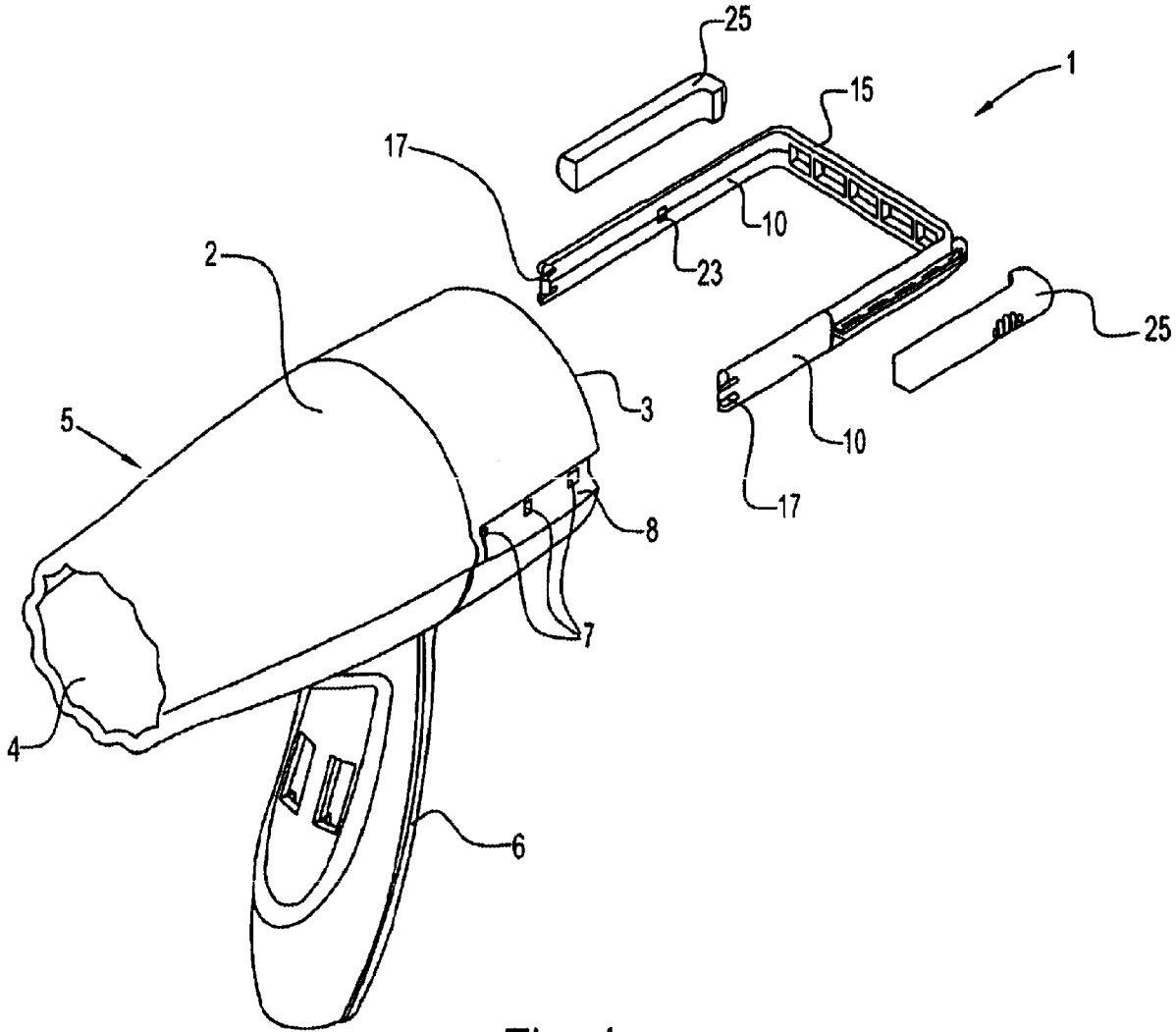
FIG. 4 is an exploded view of an illustrative hand held hair dryer employing the stand of FIG. 1.

Preferably, second surface 21 has gripping elements 25 such as those shown in FIG. 4. Gripping elements 25 can be either selectively detachable or be integral with second surface 21. Preferably, second surface 21 and/or gripping elements 25 are formed from, or coated with, a resilient material sufficient to provide both comfort and friction for user handling. Second surface 21 can also be finished to aesthetically compliment hand held hair dryer 5.

Preferably, each second end 13 of said legs 10 can be selectively, detachably connected to each other by connecting member 15 to form a frame, as illustrated in FIGS. 1 through 3. Also, each second end 13 can alternatively be permanently connected or integral to each other by connecting member 15.

It is noted that legs 10 can be selectively disconnected from hand held hair dryer 5. It should also be noted that the legs 10 can be configured to selectively cooperate with a variety of differently sized/shaped hand held hair dryers. For example, the legs 10, when combined with connecting member 15, can be configured to frictionally, engage, and cooperate with the housing of most conventional hand held hair dryers.

Connecting member 15 preferably can enable hand held hair dryer 5 to be selectively supported and/or suspended against a vertical surface, such as, for example, a wall or a door. Also, connecting member 15 can be sufficiently elastic or flexible to enable the legs 10 to be selectively, independently telescopically positioned. Further, connecting member 15, when connected to the legs 10, is preferably configured and/or positioned so as not to interfere with the operation of hand held hair dryer 5 during use.

Referring to FIG. 4, hand held hair dryer 5, preferably has at least a housing 2 with an air inlet 3, an air outlet 4 and a handle 6. Also, hair dryer 5 can have a variety of different features and/or elements foreseeably associated with hair dryers, such as for example, a power source, a motor assembly, a blower or fan, and a heater, none of which are shown. Preferably, stand 1 is disposed at the rear of housing 2 proximate air inlet 3. It is noted that hand held hair dryer 5 can have one or more channels or slots 8 that can receive and/or retain legs 10 in order to facilitate efficient utilization and storage thereof. However, hand held hair dryer 5 need not be so configured and stand 1 can be made to cooperate with most hand held hair dryers.

Thus, stand 1 and handle 6 to form an adjustable tripod that enables a user to more effectively and efficiently use hand held hair dryer 5 in a hands-free manner.

The present invention having been thus described with particular reference to the preferred forms thereof, it will be obvious that various changes and modifications may be made therein without departing from the spirit and scope of the present invention as defined herein.

What is claimed is:

1. A stand for use with a hand held hair dryer, comprising:

at least two legs, wherein said at least two legs are telescopically connected to said hand held hair dryer, said at least two legs cooperating with said hand held hair dryer to enable a user to use said hand held hair dryer in a hands-free manner.

2. The stand of claim 1, wherein said at least two legs cooperate with a handle of said hand held hair dryer to form a tripod.

3. The stand of claim 1, wherein said at least two legs can selectively disconnect from said hand held hair dryer.

4. The stand of claim 1, wherein said at least two legs are independently, telescopically connected to said hand held hair dryer.

5. The stand of claim 4, wherein said independent telescopic connection between said at least two legs and said hand held hair dryer allows said hand held hair dryer to be selectively, tiltably positioned when supported against a surface.

6. The stand of claim 1, wherein said at least two legs each have a first end, an elongated shaft and a second end opposite said first end.

7. The stand of claim 6, wherein each of said first ends has one or more connectors for cooperating with said hand held hair dryer.

8. The stand of claim 7, wherein said hand held hair dryer has one or more fasteners for cooperating with said one or more connectors.

9. The stand of claim 6, further comprising a connecting member for joining said second ends of each of said at least two legs to create a frame telescopically connected to said hand held hair dryer.

10. The stand of claim 9, wherein said frame can be selectively positioned not to interfere with the operation of said hand held hair dryer.

11. The stand of claim 9, wherein said connecting member is sufficiently flexible to enable said at least two legs to be selectively, independently telescopically positioned.

12. The stand of claim 9, wherein said connecting member enables said hand held hair dryer to be selectively supported against a vertical surface.

13. A stand for use with a hand held hair dryer, comprising:

at least two legs that cooperate with a handle of said hand held hair dryer to form a tripod, wherein said at least two legs are telescopically connected to said hand held hair dryer.

14. The stand of claim 13, wherein said at least two legs are independently, telescopically connected to said hand held hair dryer to allow said hand held hair dryer to be selectively, tiltably positioned when supported against a surface.

15. The stand of claim 13, wherein said tripod enables a user to use said hand held hair dryer in a hands-free manner.

16. The stand of claim 13, wherein said at least two legs are relatively compact and can be selectively detached from said hand held hair dryer.

17. The stand of claim 13, further comprising a connecting member for connecting said at least two legs to form a frame telescopically connected to said hand held hair dryer.

18. The stand of claim 17, wherein said frame can be selectively positioned not to interfere with the operation of said hand held hair dryer and to be easily and conveniently engaged.

19. The stand of claim 13, wherein said hand held hair dryer receives and retains said at least two legs to facilitate efficient use and storage thereof.

20. The stand of claim 13, wherein said at least two legs can selectively cooperate with different sized/shaped hand held hair dryers.

* * * * *